US007313891B2

(12) United States Patent
Showers

(10) Patent No.: US 7,313,891 B2
(45) Date of Patent: Jan. 1, 2008

(54) WALL FINISHING SYSTEM

(76) Inventor: Robert J. Showers, 2592 Six Mile Run, Philipsburg, PA (US) 16866

( * ) Notice: Subject to any disclaimer, the term of this patent is extended or adjusted under 35 U.S.C. 154(b) by 0 days.

(21) Appl. No.: 11/184,822

(22) Filed: Jul. 20, 2005

(65) Prior Publication Data

US 2006/0236653 A1 Oct. 26, 2006

Related U.S. Application Data

(60) Provisional application No. 60/672,875, filed on Apr. 20, 2005.

(51) Int. Cl.
*E04B 2/00* (2006.01)

(52) U.S. Cl. ..... 52/267; 52/241; 52/242; 52/270; 52/269; 52/268; 52/506.05; 52/506.01; 52/169.11; 52/169.5

(58) Field of Classification Search ..... 52/241, 52/242, 270, 267, 269, 268, 506.05, 506.01, 52/169.5, 169.11
See application file for complete search history.

(56) References Cited

U.S. PATENT DOCUMENTS

| | | | | |
|---|---|---|---|---|
| 1,999,741 | A * | 4/1935 | Schultz | 52/242 |
| 2,540,305 | A * | 2/1951 | Tomlinson | 52/242 |
| 3,830,027 | A * | 8/1974 | Paisley et al. | 52/211 |
| 3,949,827 | A | 4/1976 | Witherspoon | |
| 4,114,345 | A * | 9/1978 | Nilsen | 52/745.02 |
| 4,129,972 | A | 12/1978 | Sherman et al. | |
| 4,286,420 | A | 9/1981 | Pharmakidis | |
| 4,385,850 | A | 5/1983 | Bobath | |
| 4,525,960 | A | 7/1985 | Kelman | |
| 4,586,305 | A * | 5/1986 | Balinski | 52/241 |
| 4,653,241 | A | 3/1987 | Bindi | |
| 5,035,095 | A | 7/1991 | Bevilacqua | |
| 5,158,392 | A | 10/1992 | Takeda | |

(Continued)

FOREIGN PATENT DOCUMENTS

FR 2 597 903 10/1987

(Continued)

OTHER PUBLICATIONS

APA The Engineered Wood Association Structural Insulated Panels, 12 pages, Dec. 1998.

(Continued)

*Primary Examiner*—Jeanette Chapman
*Assistant Examiner*—Dan Kenny
(74) *Attorney, Agent, or Firm*—Richard C. Litman

(57) ABSTRACT

The wall insulating and finishing system is a system for finishing a concrete structure to increase the amount of useable space in a building. The finishing system comprises a plurality of connectable panels. An insulation layer is secured to the rear surface of the panels. The insulation layer has a generally flat front surface that is secured to the rear surface of the panels. The insulation layer also provides an uneven rear surface that is positioned adjacent to the existing basement foundation wall, and a pair of uneven side surfaces. The uneven rear and side surfaces of the insulation layer provide a plurality of grooves or dimples that allow moisture and air to move freely between the wall structure and the insulation layer. The panels and insulation layer are mounted to the existing wall structure by mounting brackets.

12 Claims, 14 Drawing Sheets

U.S. PATENT DOCUMENTS

| | | | | |
|---|---|---|---|---|
| 5,373,674 | A * | 12/1994 | Winter, IV | 52/309.9 |
| 5,535,556 | A | 7/1996 | Hughes, Jr. | |
| 5,617,700 | A | 4/1997 | Wright et al. | |
| 5,715,638 | A * | 2/1998 | Anderson, Sr. | 52/506.08 |
| 5,799,462 | A | 9/1998 | McKinney | |
| 5,890,334 | A | 4/1999 | Hughes, Jr. | |
| 5,953,883 | A | 9/1999 | Ojala | |
| 6,035,594 | A | 3/2000 | Leslie | |
| 6,041,561 | A | 3/2000 | LeBlang | |
| 6,141,929 | A | 11/2000 | Kistner et al. | |
| 6,240,704 | B1 | 6/2001 | Porter | |
| 6,247,280 | B1 | 6/2001 | Grinshpun et al. | |
| 6,449,915 | B1 | 9/2002 | Park | |
| 6,460,305 | B1 | 10/2002 | VanHaitsma et al. | |
| 6,477,811 | B1 | 11/2002 | Choi | |
| 6,588,165 | B1 | 7/2003 | Wright | |
| 6,918,212 | B1 * | 7/2005 | Anderson, Sr. | 52/506.05 |
| 7,104,018 | B2 * | 9/2006 | Romes et al. | 52/405.1 |
| 2001/0023565 | A1 * | 9/2001 | Snider et al. | 52/408 |
| 2002/0083662 | A1 | 7/2002 | Burton | |
| 2003/0150183 | A1 | 8/2003 | Egan | |
| 2003/0177722 | A1 | 9/2003 | Young | |
| 2004/0219853 | A1 | 11/2004 | Weir et al. | |

FOREIGN PATENT DOCUMENTS

| | | |
|---|---|---|
| GB | 1066229 | 8/1964 |
| JP | 58-29921 | 2/1983 |
| JP | 63-300124 | 12/1988 |
| JP | 4-102628 | 4/1992 |
| JP | 8-239946 | 9/1996 |

OTHER PUBLICATIONS

Forrester Products Forrester Products Journal—Structured Insulated Panels, 9 pages, vol. 50, No. 3, Mar. 2000.

Structural Insulated Panel Association Department of Energy laboratory shows new way to win the energy wars at home, 5 pages, Sep. 2002.

* cited by examiner

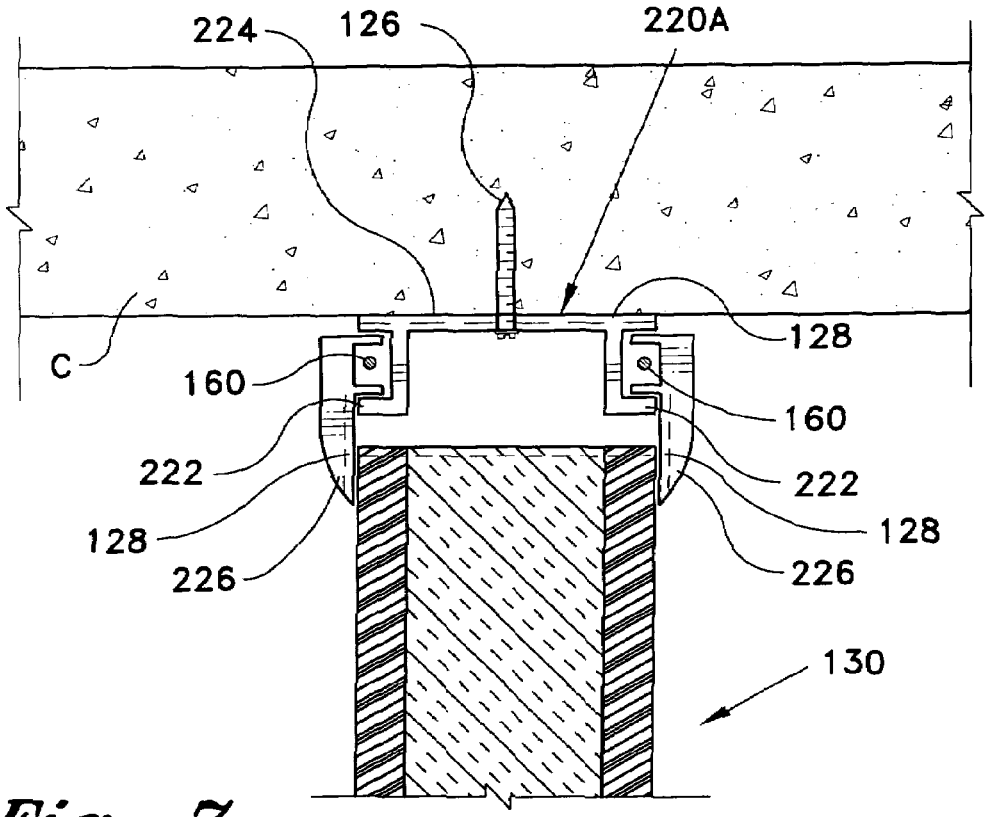
*Fig. 7*
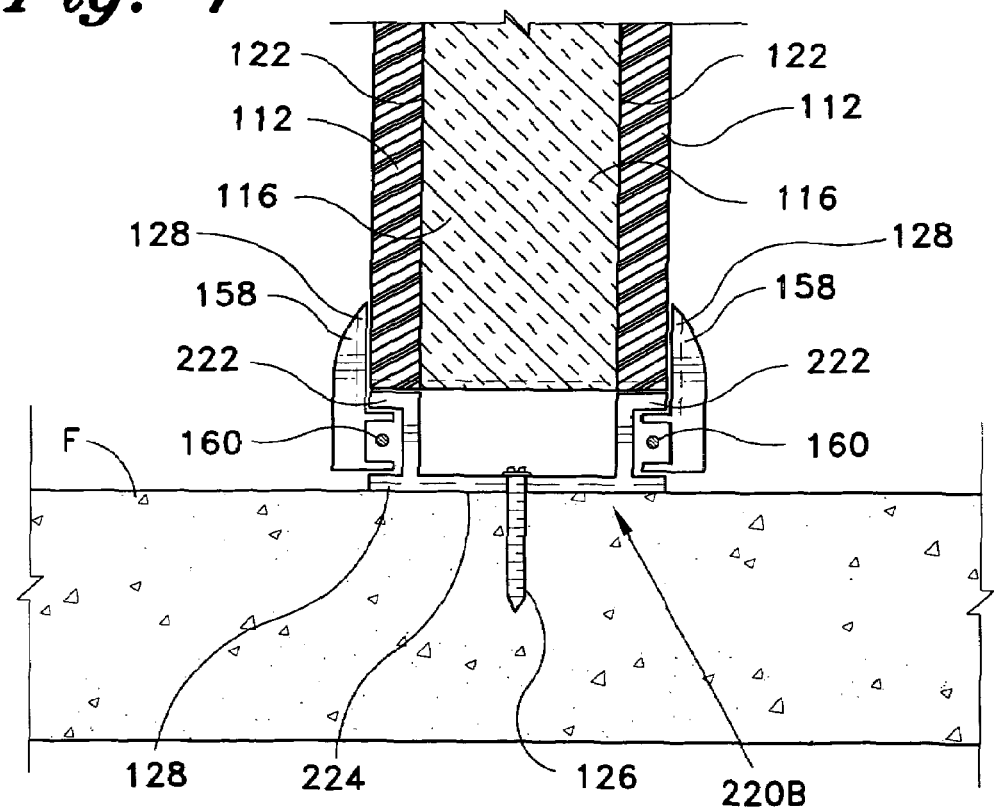

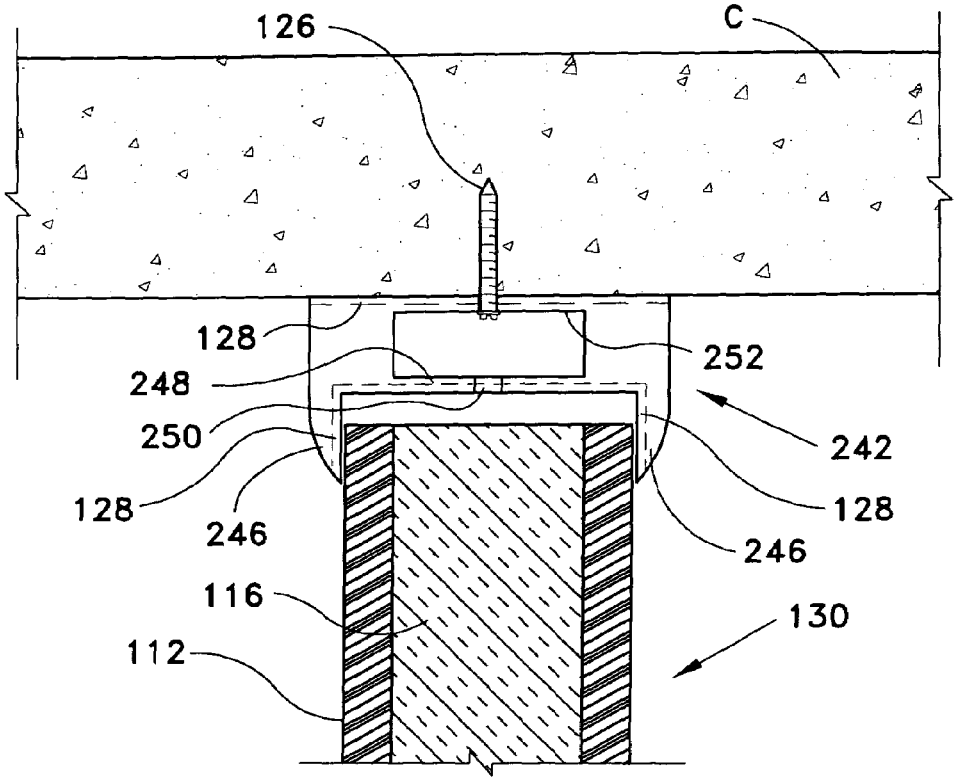
*Fig. 10*
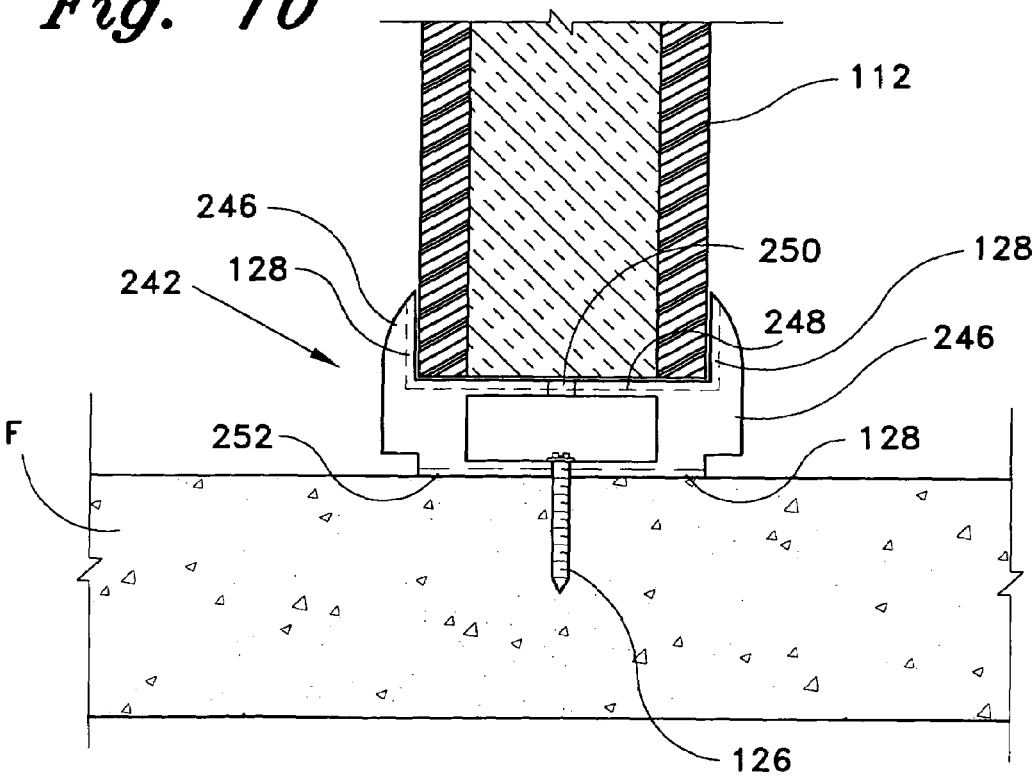

WALL FINISHING SYSTEM

CROSS-REFERENCE TO RELATED APPLICATION

This application claims the benefit of U.S. Provisional Patent Application Ser. No. 60/672,875, filed Apr. 20, 2005.

BACKGROUND OF THE INVENTION

1. Field of the Invention

The present invention relates to insulating wall panels and more particularly to a system of panels that are mountable to existing masonry walls for finishing and insulating the walls of a building.

2. Description of the Related Art

Homeowners commonly finish the basements of their home to increase the living space in the home. When finishing a basement it is necessary to consider the environmental conditions of a typical basement. Basements commonly have increased humidity levels and an increased possibility of occasional moisture. It is necessary to provide basement wall finishing materials that protect the contents of the basement from these conditions. It is also necessary that the basement wall finishing materials allow access to the foundation walls for periodic inspection for mold, water leaks, insect damage, structural damage, or radon gas entry.

Traditionally, drywall has been used to cover the foundation walls when finishing a basement. Drywall, however, does not properly protect the basement from humidity and moisture. Furthermore, insulation must also be combined with the drywall to insulate the basement and to provide noise control in the basement.

When finishing these foundation walls, the drywall and insulation panels are prepared and assembled at the jobsite, which may be an expensive and time-consuming task. Preparing and assembling modular wall panels in factory, then simply having the panels installed once the panels reach the jobsite would help to reduce the labor cost at the jobsite.

These problems of moisture control, access for inspection, and ease in finishing apply to other concrete structures as well. Most tall office and apartment buildings have concrete support beams, floors and walls. These structures must also be finished before they are habitable.

The Japanese patent 58-29921, published Feb. 22, 1983, discloses a method for sealing an outer wall panel in a basement from moisture. The method involves covering the outer wall panel with a waterproof film so as to form a recessed cavity between the wall and the film. A vent hole is formed into the recess to allow moisture that forms in the cavity to be exhausted.

The Japanese patent 63-300124, published Dec. 7, 1988, discloses a method for forming pre-fabricated concrete basement wall panels with solid bases. These wall panels are unfinished, exterior panels.

The Japanese patent 8-239946, published Sep. 17, 1996, discloses a basement wall panel with a corrugated plate and a waterproof plate secured to a frame.

Thus a wall finishing system solving the aforementioned problems is desired.

SUMMARY OF THE INVENTION

The masonry wall insulating and finishing system is a system for finishing a basement or other concrete structure to increase the amount of livable or useable space in the building. The finishing system comprises a plurality of connectable panels. The panels are made from rigid material that will define the interior surface of the finished walls. An insulation layer is secured to the rear surface of the panels.

The insulation layer acts as a waterproof, vapor barrier that will insulate the finished basement and add structural support to the panels. The insulation layer has a generally flat front surface that is secured to the rear surface of the panels. The insulation layer also provides an uneven rear surface that is positioned adjacent to the existing basement foundation wall, and a pair of uneven side surfaces. The uneven rear and side surfaces of the insulation layer provide a plurality of grooves or dimples. The uneven surfaces of the insulation material allow the panels to be positioned directly against the existing basement walls while allowing moisture and air to move freely between the insulation layer and the existing basement wall. This allows for ventilation and prevents moisture and water from collecting behind the wall panels.

The panels and insulating layer are mounted to the existing masonry walls using mounting brackets. The finishing system provides top mounting brackets and bottom mounting brackets. The top basic mounting bracket is secured along the basement ceiling and defines a U-shaped channel that extends along the entire length of the basement wall. The bottom basic mounting bracket is secured along the basement floor and defines a U-shaped channel that extends along the entire length of the basement wall. The panels and the insulation layer are secured inside of the top basic bracket and the bottom basic bracket, and are held in place against the existing basement walls. The panels and brackets may be factory-prepared and assembled, allowing for quicker installation once the finishing system arrives at the jobsite.

It must be appreciated here that the wall finishing system of the invention significantly reduces the number of framing studs needed. Also, the system of this invention can be used anywhere existing walls need to be remodeled with insulation, and further be provided with a finished interior wall with trim. Thus, the inventive system can be used for office space, warehouse space, or any other space in need of remodeling, insulating, constructing, framing or trimming.

These and other features of the present invention will become readily apparent upon further review of the following specification and drawings.

BRIEF DESCRIPTION OF THE DRAWINGS

FIG. 7 is a cross-section view of an interior wall panel and interior brackets of the wall finishing system according to the present invention.

FIG. 10 is a cross-section view of an interior wall panel and one-piece interior wall brackets of the wall finishing system according to the present invention.

Similar reference characters denote corresponding features consistently throughout the attached drawings.

DETAILED DESCRIPTION OF THE PREFERRED EMBODIMENTS

Figure 1:
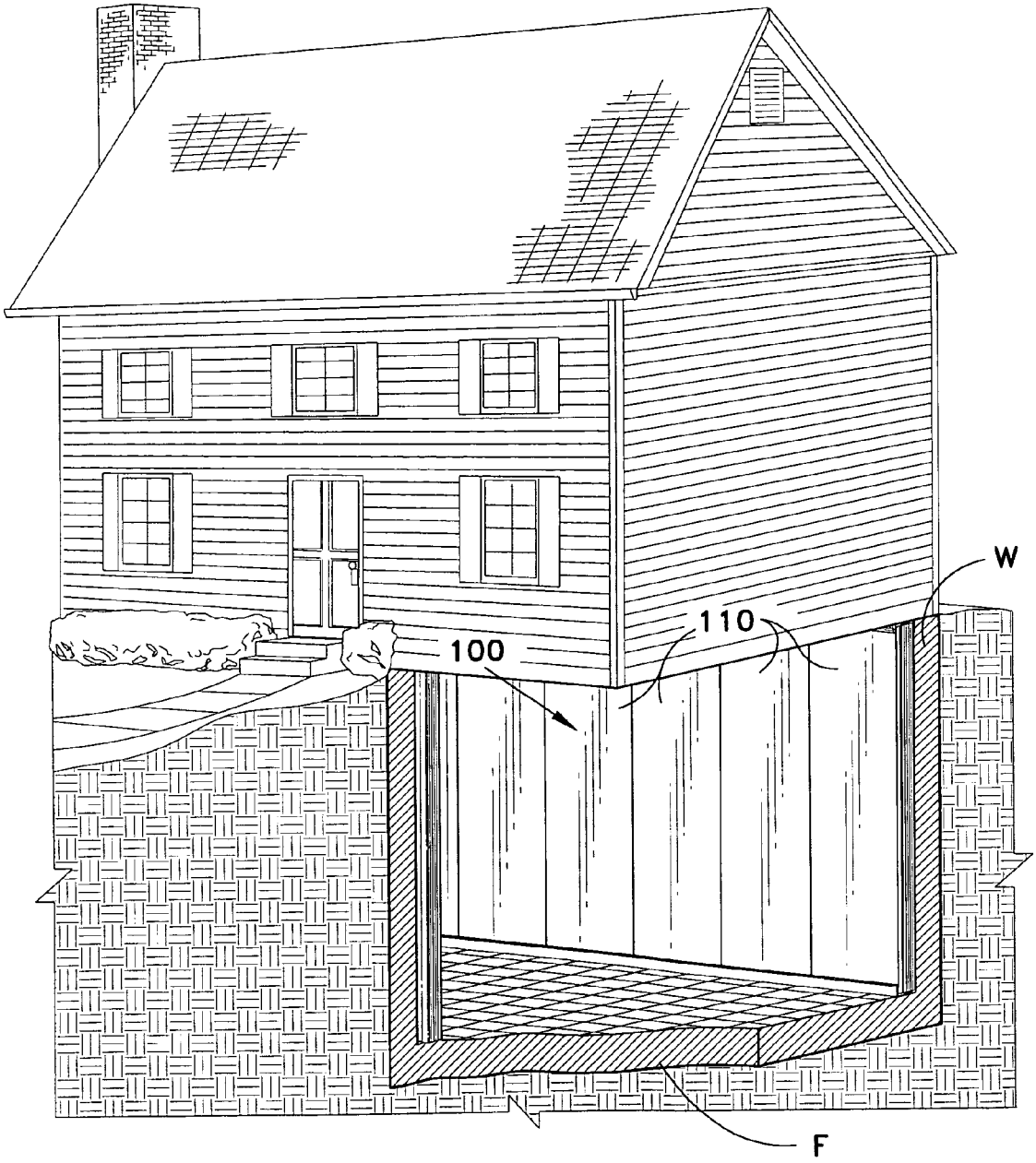
FIG. 1 is an environmental, perspective view of a wall finishing system according to the present invention.

The present invention is a masonry wall insulating and finishing system, designated generally as 100 in the figures, and is a system for finishing a basement or other enclosed concrete structure to increase the amount of livable space in the building, as shown in FIG. 1. The finishing system 100 comprises a plurality of connectable panels 110. The forward section 112 of each of the panels is made from a rigid material that will define the interior surface of the finished walls. This material may include mold-resistant gypsum board, or any other common interior wall paneling, and can have a painted or wallpaper pre-finish, or vinyl covering, or any other finishing material typically used in the industry. Where the panels are applied over exposed areas, the forward section 112 of the panels may be finished with an exterior finish, such as aluminum or vinyl siding, stucco, or shingles. In any event, the covering(s) may be factory-applied before shipping or may be installed on site. Additionally, the panels, brackets and all other components of the system may be factory-prepared and applied or prepared for simple installation on site.

Figure 17:
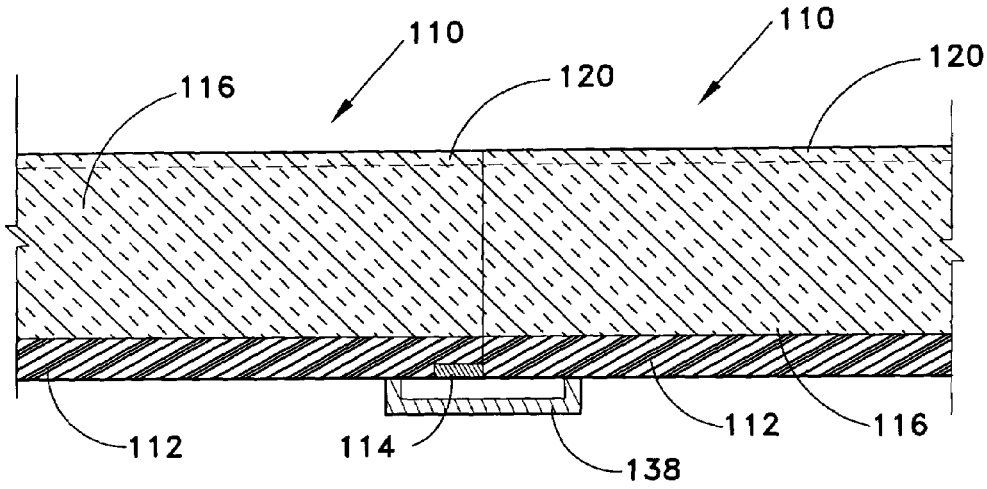
FIG. 17 is a top cross-section view of a wall panel connection in the wall finishing system according to the present invention.

Adjacent wall panels 110 are secured together using batten strips 114 (see FIG. 17), as is typically used in the industry for joining drywall panels together. However, the batten strips 114 are only secured to one panel 110 at each connection, or separate batten strips 114 may be secured to each panel 110 at each connection without overlapping, so that the panels 110 may be easily removed for inspection and possible repair of the wall W. Referring back to FIG. 2, it can be seen that the batten strip 114 may be integrated into the full side 124 of the wall panel 110 to act as a strengthening support in lieu of a separate framing stud. The integrated batten strip, when used in a wall panel that is not to be removed, may be secured to ceiling, floor, wall or any brackets used to secure the panels the batten strip is integrated into. It should be noted here that the panels with batten strips attached to only one of the adjacent panels may be easily removed and later put back, without the need of tools and/or any repair to the panel so removed and replaced, or its neighbor. The batten may be made of any suitable material, such as metal, plastic, fiberglass or other rigid, fire-resistant material, and may include an integrated wire cavity. The batten may be one piece, or may include a plurality of sections secured together before being applied to the wall. When the batten is metal, it may additionally include a plastic thermal break to reduce the heat that is transferred between the exterior and interior of the room. As can be appreciated from FIG. 17 and the above discussion, the battens 114 provide additional strength and stability to the overall system, thus significantly reducing the need for conventional studs. Also as seen in FIG. 17, and if desired, a batten strip trim 138 section may be snapped into place over the batten strips 114 to decoratively cover the batten strips 114. The batten strip trim 138 may be made of a fire-resistant material, and is preferably used to overlap both panels 110 where the batten strip 114 does not overlap both panels 110. At inside and outside corners, a factory-applied batten can be provided as a decorative cover for corner seams, where panels join creating seams at the corners. Again, the batten is attached to only one of the adjacent panels.

Figure 2:
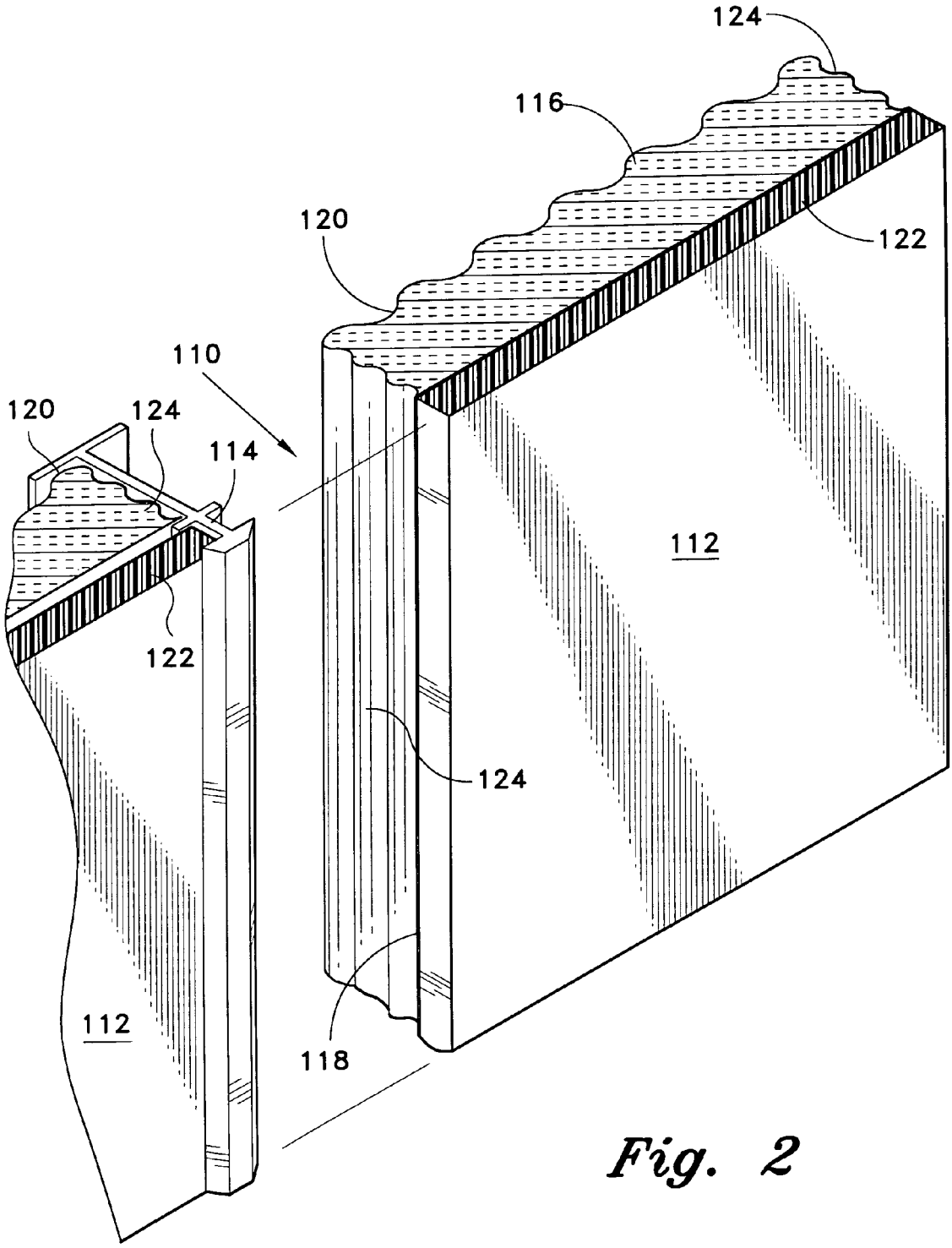
FIG. 2 is perspective view of a modular wall panel for the wall finishing system according to the present invention.

As shown in FIG. 2, an insulation layer 116 is secured to the rear surface 118 of the forward section 112 of the panels 110. The insulation layer 116 acts as a waterproof vapor barrier that will insulate the finished basement and add structural support to the panels 110. In a preferred embodiment, the insulation layer 116 is formed from expanded polystyrene, however, other materials with similar insulating properties, such as fiberglass, rock wool, or polyester may be used with an added vapor barrier. The insulation layer 116 may include an insecticide to help prevent the entry of insects into the finished building. The insulation layer 116 has a generally flat front surface 122 that is secured to the rear surface 118 of the panels. The insulation layer 116 also provides an uneven rear surface 120 that is positioned adjacent to the existing basement foundation wall W, and a pair of uneven side surfaces 124. The uneven rear 120 and side 124 surfaces of the insulation layer 116 provide a plurality of grooves or dimples. The uneven surfaces of the insulation material allow the panels 110 to be positioned directly against the existing basement walls W while allowing moisture and air to move freely between the insulation layer 116 and the existing basement wall W. This allows for ventilation, as the air and water may circulate around the wall panels 110, and prevents moisture and water from collecting behind the wall panels 110. Also, especially if required by local fire codes or at any other time when additional strength is needed, the insulation layer 16 may have a factory-applied layer of thin metal.

Additionally, interior wall panels 130 may be used in the finishing system 100, as shown in FIG. 7. These interior wall panels 130 have a layer of rigid finishing material 112 attached to both the front 122 and rear surfaces 120 of the insulation layer 116. The interior wall panels 130 are used to create walls that extend out normal to the masonry walls W, dividing the interior space of the building into rooms.

Figure 18:
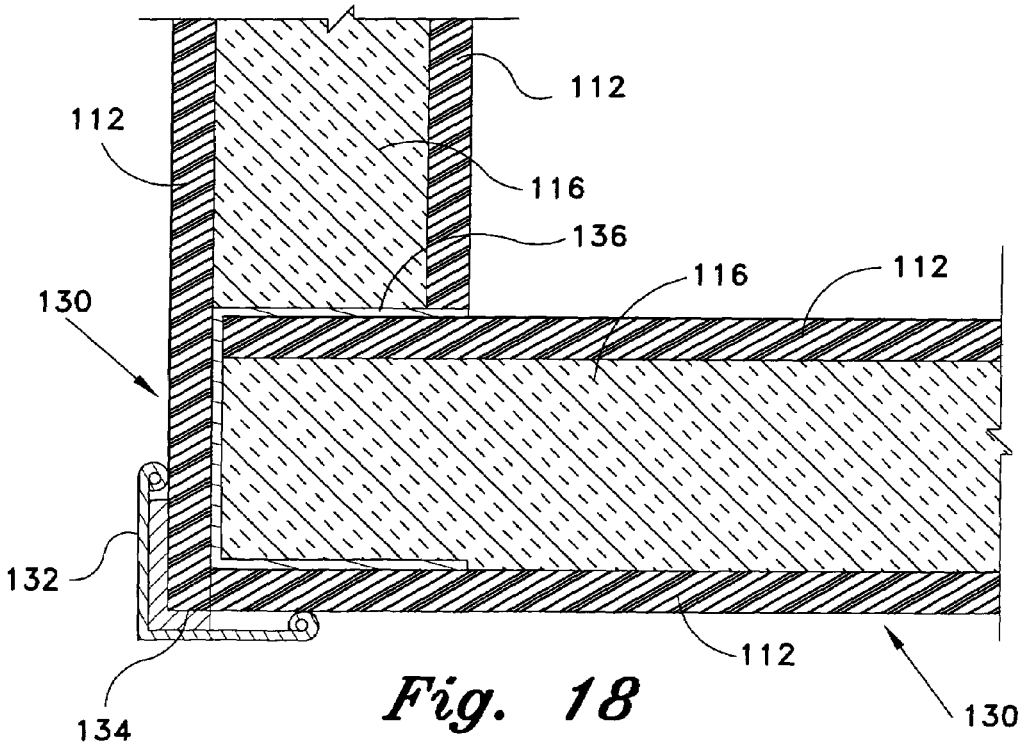
FIG. 18 is a top cross-section view of an outside corner of an interior wall of the wall finishing system according to the present invention.

Referring now to FIG. 18, snap-on corner trim 132 may be used to secure one interior wall panel normal to another interior wall panel. The corner trim 132 is secured over a metal corner flashing 134. A C-shaped bracket 136 may be used over the end of one of the panels 130 to add structural support to the corner.

Figure 3:
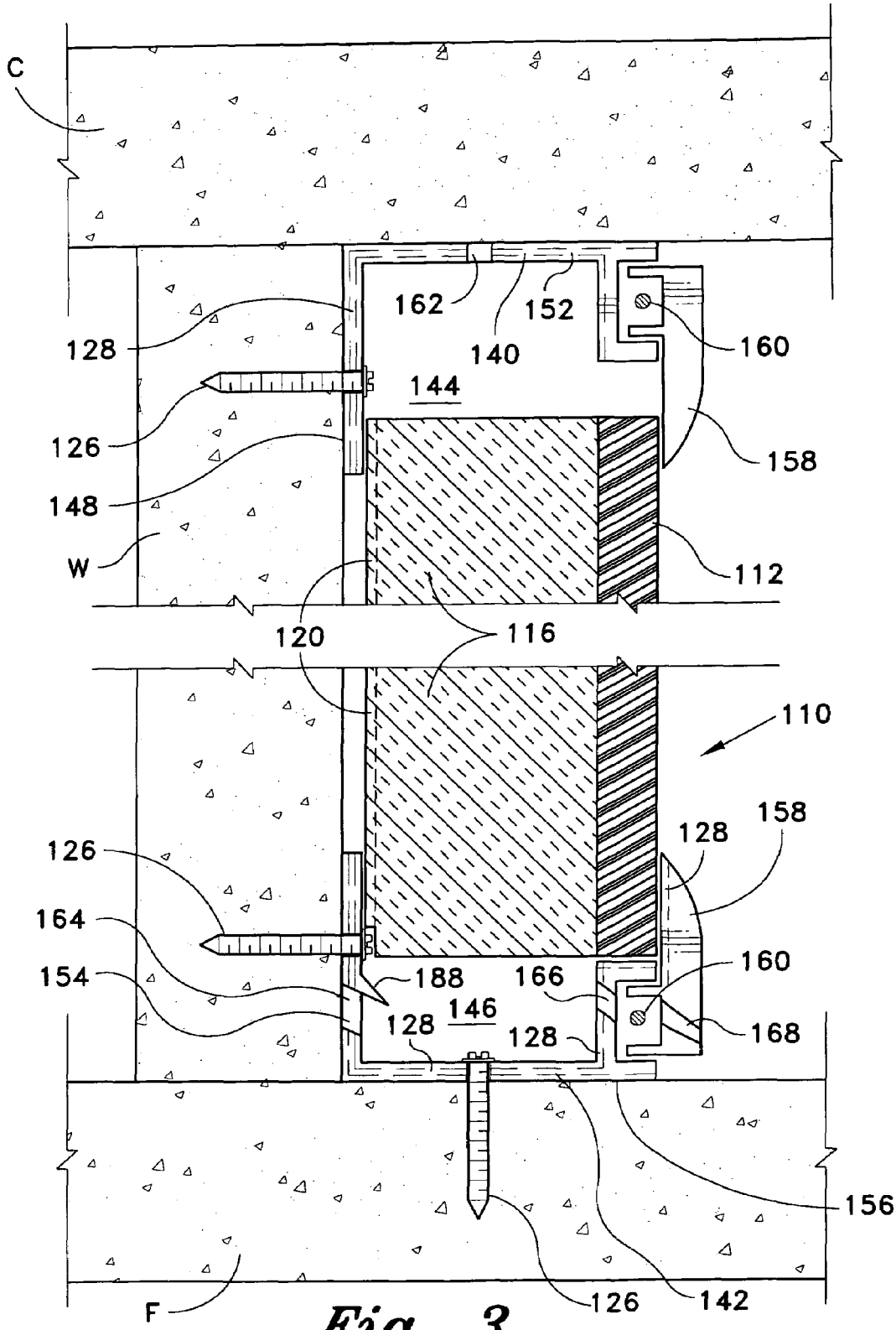
FIG. 3 is a side cross-section view of a wall panel and basic brackets for the wall finishing system according to the present invention.

The panels 110 are mounted to the existing masonry walls W and floor F using mounting brackets. The finishing system 100 provides top mounting brackets and bottom mounting brackets. As shown in FIG. 3, the top basic mounting bracket 140 is secured along the basement ceiling C and defines a U-shaped channel 144 that extends along the entire length of the basement wall W. The bottom basic mounting bracket 142 is secured along the basement floor F and defines a U-shaped channel 146 that extends along the entire length of the basement wall W. The U-shaped channel 146 is adapted to collect and distribute water away from the masonry wall W and interior of the room. A water deflection lip 188 may be disposed on the interior of the rear surface 154 of the bottom basic bracket 142 to deflect any water draining from the grooves 128 into the U-shaped channel 146. The panels 110 are secured inside of the top basic bracket 140 and the bottom basic bracket 142, and are held in place against the existing basement walls W.

The top basic bracket 140 and the bottom basic bracket 142 may both be secured to the masonry wall W using concrete fasteners 126. The rear surface 148 and top surface 152 of the top basic bracket 140 may have grooves 128 or dimples to allow air and moisture to circulate around the bracket 140. The rear surface 154 and bottom surface 156 of the bottom basic bracket 142 may have grooves 128 or dimples to allow air and moisture to circulate around the bracket 142. In addition, the interior surfaces of all brackets used in the finishing system may have dimples or grooves 128 to allow air and moisture to pass between the wall panels 110 and the brackets, venting the air and moisture into the room. Regularly spaced vents 164 may be defined in the rear surface 148 of the bottom basic bracket 142 to allow air to pass from the grooves 128 to the U-shaped channel 146. Additional regularly spaced vents 166 may be defined in the bottom basic bracket 142 to allow air to pass over the low voltage wire chase 160. Optionally, a drain may be formed in the wall or floor behind at least one bottom basic bracket 142 to allow any water that passes along the grooves 128 and into the U-channel 146 on the bottom basic bracket 142 to be drained out of the building.

The top basic bracket 140 and the bottom basic bracket 142 both are adapted to receive a section of decorative trim 158 in front of the wall panel 110. The trim 158 may snap into the top basic bracket 140 or bottom basic bracket 142. A low voltage wire chase 160 may be run between the bottom basic bracket 142 and the decorative trim 158, or between the top basic bracket 140 and the decorative trim 158, in order to connect to telephones, speakers, cable television, or intercoms. The decorative trim 158 may include regularly spaced vents 168 to allow air to pass through the bottom basic bracket 142 and into the room. The top basic bracket 140 may include a hole 162 defined in the top surface 152 of the top basic bracket 140 that allows electrical wiring or plumbing to be passed through the bracket 140.

Figure 4:
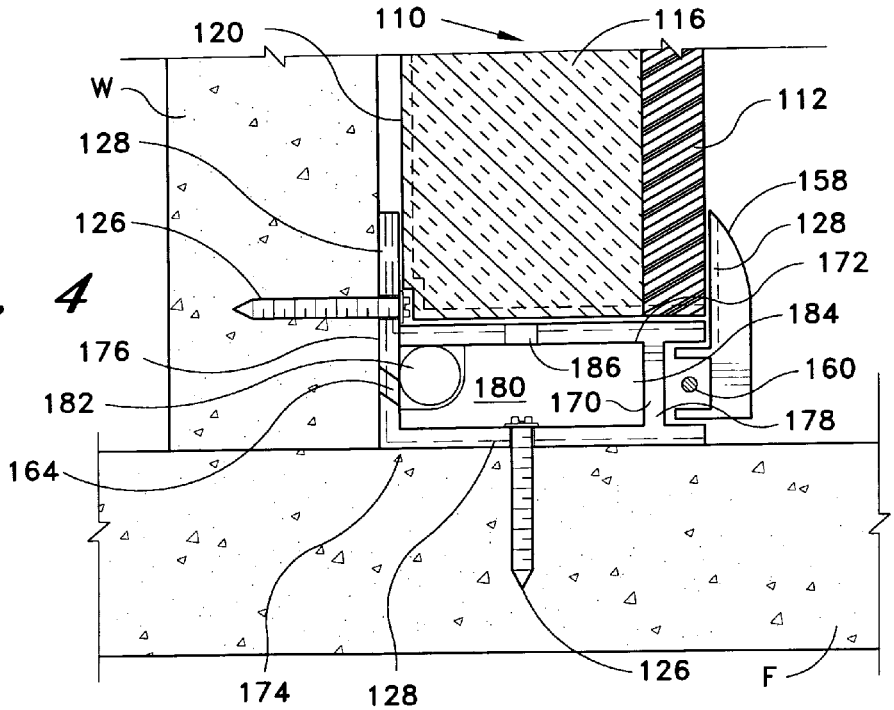
FIG. 4 is a side cross-section view of a wall panel and a conduit bracket of the wall finishing system according to the present invention.

Alternatively to the bottom basic bracket 142, several other bracket embodiments may be used to help support and secure the wall panels 110. Referring to FIG. 4, the conduit bracket 170 has a top plate 172 that, together with the bottom plate 174, rear plate 176 and trim receiving section 178, defines a central cavity 180. This central cavity 180 may contain a UL rated electrical conduit 182. The cavity 180 may also include insulation 184. A hole 186 defined in the top plate 172 may be used to access the concrete fastener 126 that is securing the conduit bracket 170 to the floor F. The conduit bracket 170 may have grooves 128 or dimples on the rear plate 176 and bottom plate 174 to allow air and moisture to circulate around the bracket 170. Again, the top plate 172 may include dimples or grooves 128 to allow ventilation between the conduit bracket 170 and the wall panels 110.

Figure 5:
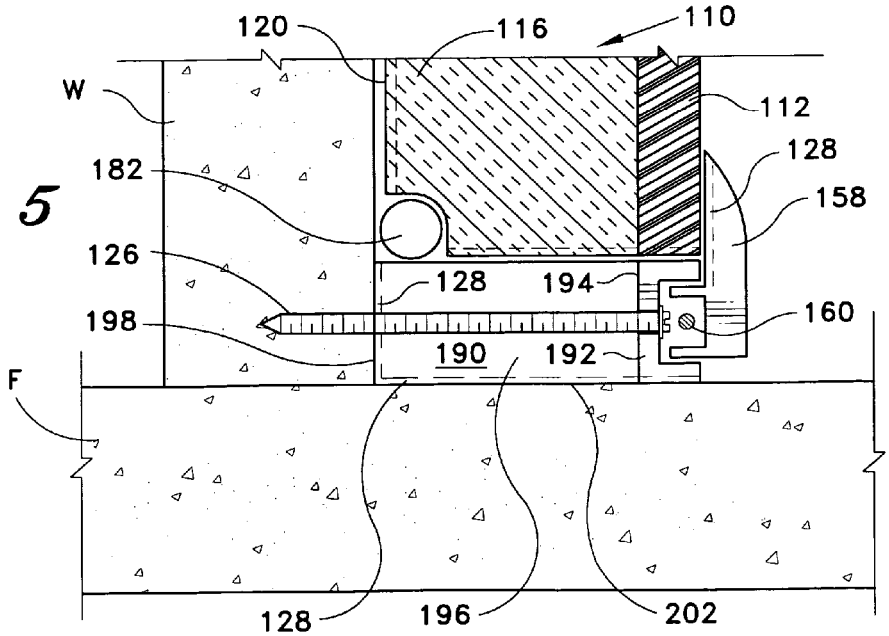
FIG. 5 is a side cross-section view of a wall panel and a solid bracket of the wall finishing system according to the present invention.

As shown in FIG. 5, the solid bracket 190 comprises a C-shaped trim receiving section 192 mounted to the front surface 194 of a rigid, sturdy block of insulating material 196. A concrete fastener 126 may be used to secure the trim-receiving section 192 and insulating block 196 to the masonry wall W. The block of insulating material 196 may have grooves 128 or dimples on the rear surface 198 and bottom surface 202 to allow air and moisture to circulate around the bracket 190. Additionally, the interior surfaces of the solid bracket 190 may include dimples or grooves 128 to allow ventilation between the solid bracket 190 and the wall panels 110.

Figure 6:
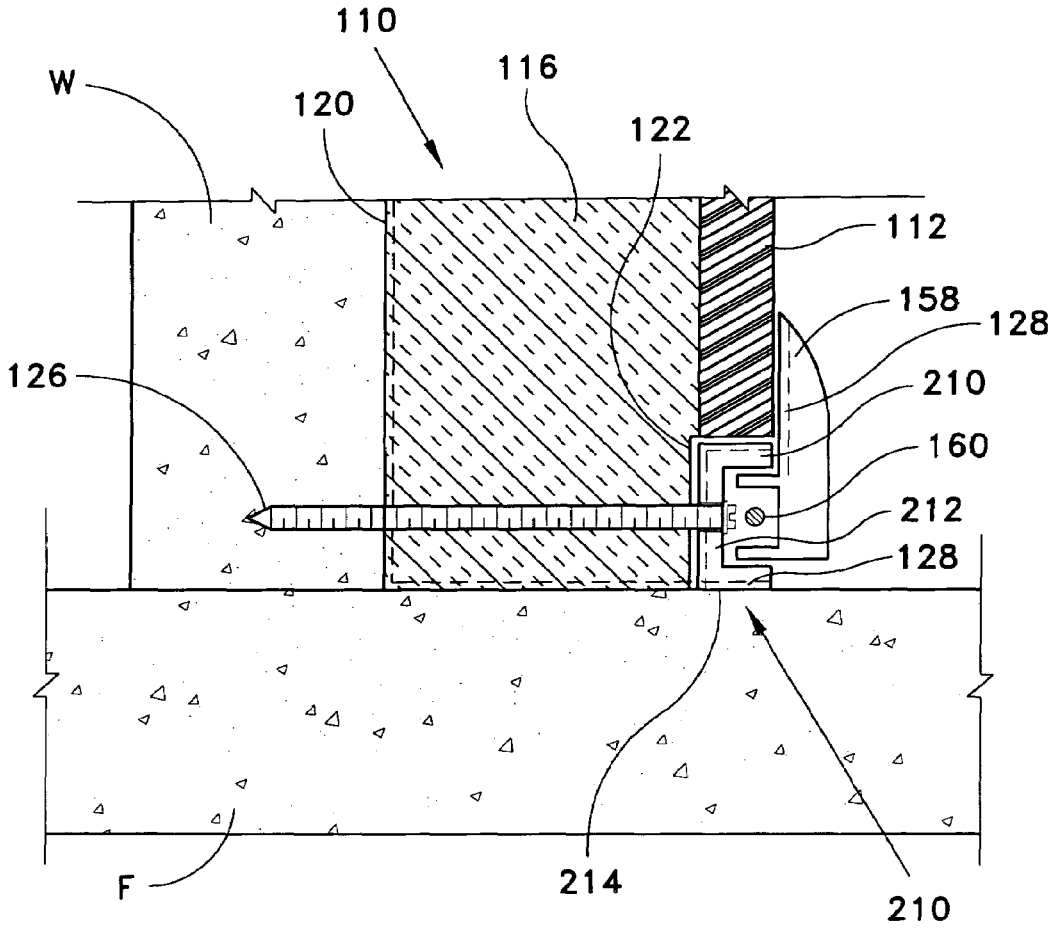
FIG. 6 is a side cross-section view of a wall panel and a short bracket of the wall finishing system according to the present invention.

Referring to FIG. 6, the short bracket 210 comprises a C-shaped trim receiving section 212 that may be mounted directly to the front surface 122 of the insulation layer 116 of the wall panel 110. A section of the gypsum board panel 112 may be cut away, and a concrete fastener 126 is used to connect the short bracket 210 to the insulation layer 116 behind the cut-away gypsum board section and to the masonry wall W. The short bracket 210 has grooves 128 or dimples on the bottom surface 214 to allow air and moisture to circulate around the bracket 210.

Referring again to FIG. 7, the interior bracket 220 comprises opposing C-shaped trim receiving sections 222 that are connected by a bottom plate 224. The bottom plate 224 may be secured to the floor F or ceiling C using a concrete fastener 126. The trim 158 may be snapped into both sides of the bottom interior bracket 220B before the interior wall panel 130 is inserted. The top interior trim 226 is longer, to allow the wall panel 130 to be lifted into the top interior bracket 220A, then slid down into the bottom interior bracket 220B. The interior bracket 220 has grooves 128 or dimples on the bottom plate 224 to allow air and moisture to circulate around the bracket 220.

Figure 8:
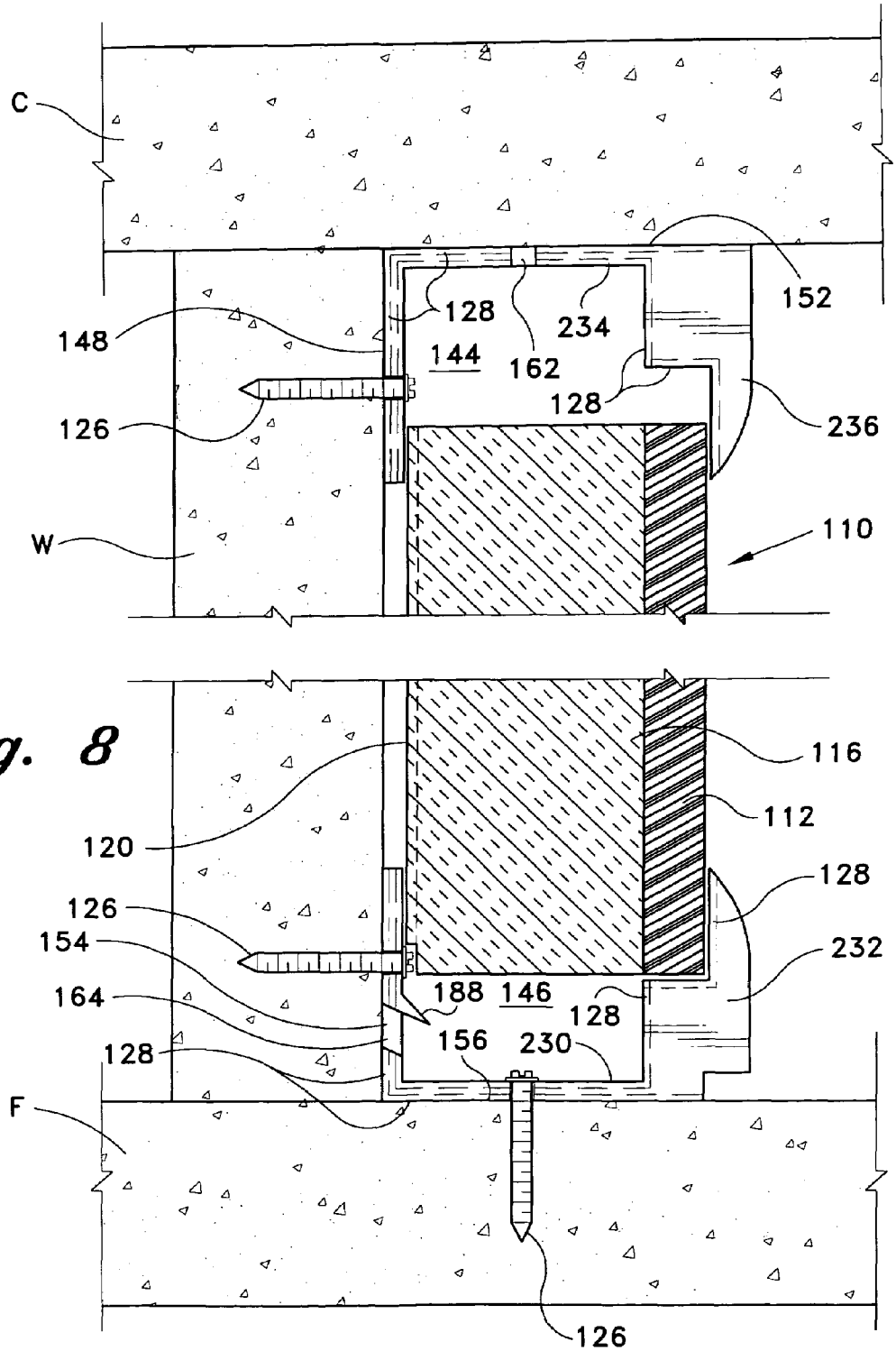
FIG. 8 is a side cross-section view of a wall panel and one-piece basic brackets of the wall finishing system according to the present invention.
Figure 9:
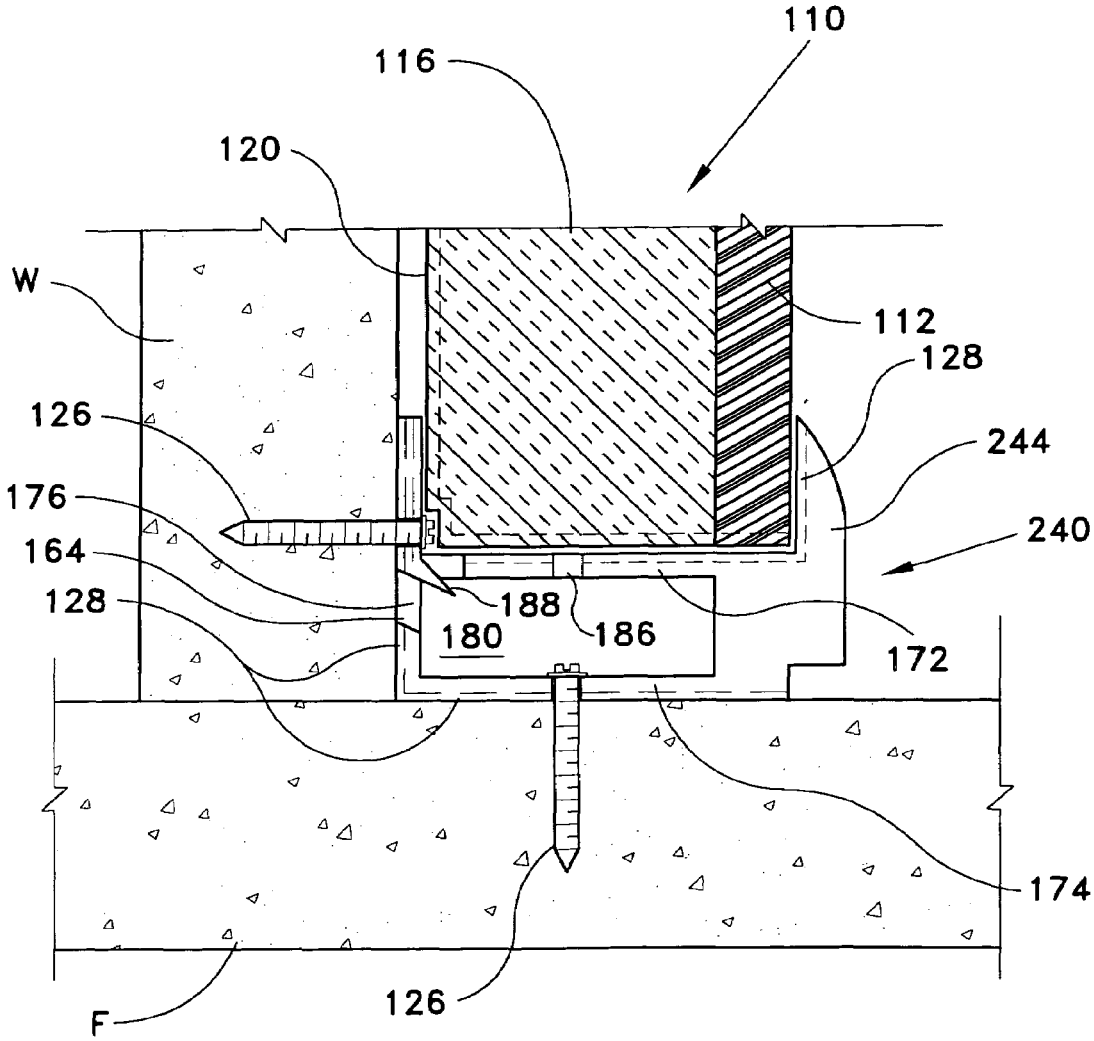
FIG. 9 is a side cross-section view of a wall panel and a one-piece conduit bracket of the wall finishing system according to the present invention.

Optionally, as shown in FIG. 8, the one-piece bottom basic bracket 230 may have integral trim 232, and the one-piece top basic bracket 234 may have slightly longer integral trim 236. Referring to FIG. 9, the one-piece conduit bracket 240 may also include integral trim 244, and one-piece interior bracket 242 may also include integral trim 246, as shown in FIG. 10. The one-piece interior bracket 242 may additionally comprise a top plate 248 with an access hole 250 defined therein to allow the concrete fastener 126 to be inserted into the bottom plate 252.

Figure 11:
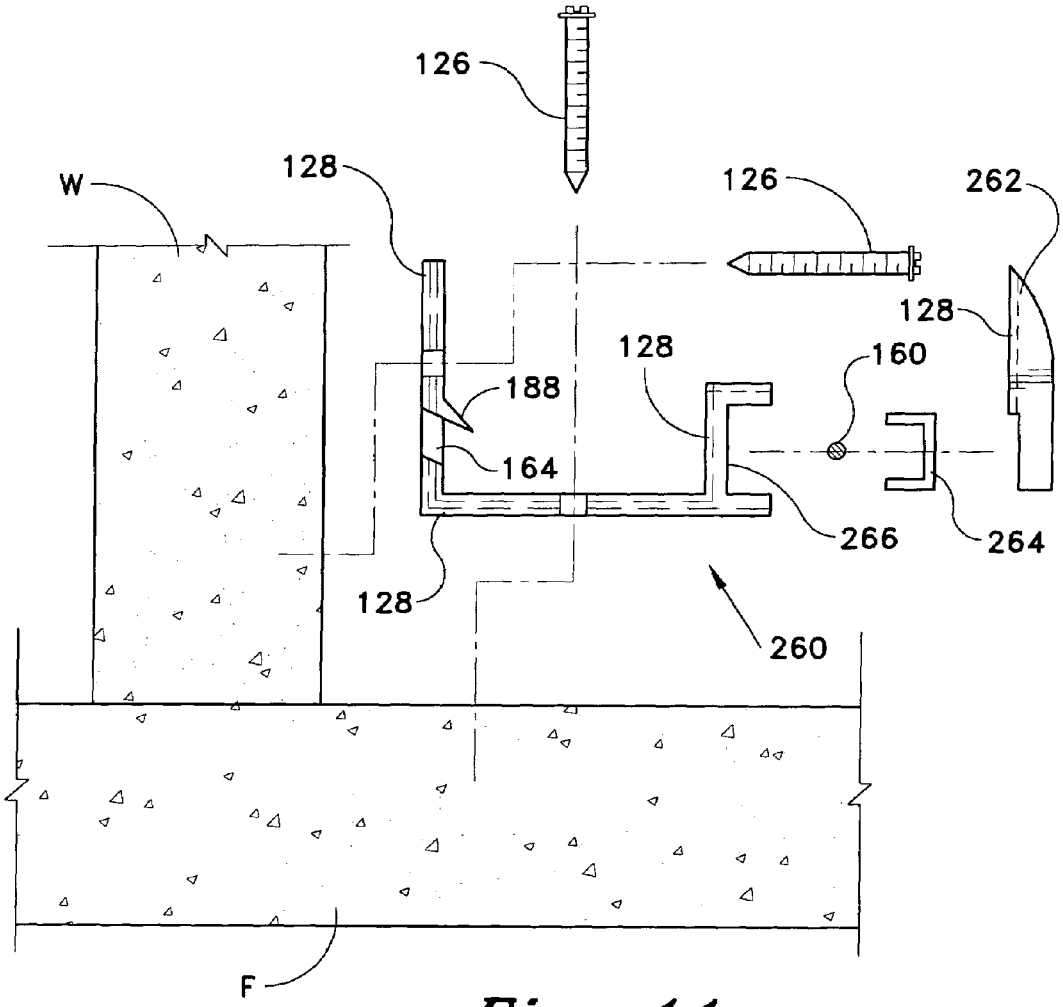
FIG. 11 is an exploded side cross-section view of a three-piece basic bracket of the wall finishing system according to the present invention.

Referring to FIG. 11, a three-piece basic bracket 260 may be used to allow the trim 262 to be removed and replaced with trim having various ornamental designs. The trim 262 has a means for removably securing the trim 262 to a cover piece 264. The cover piece 264 snaps into the trim-receiving section 266 on the three-piece basic bracket 260. The cover piece 264 prevents the low-voltage wire chase 160 from being exposed as the ornamental trim 262 is replaced.

Figure 15:
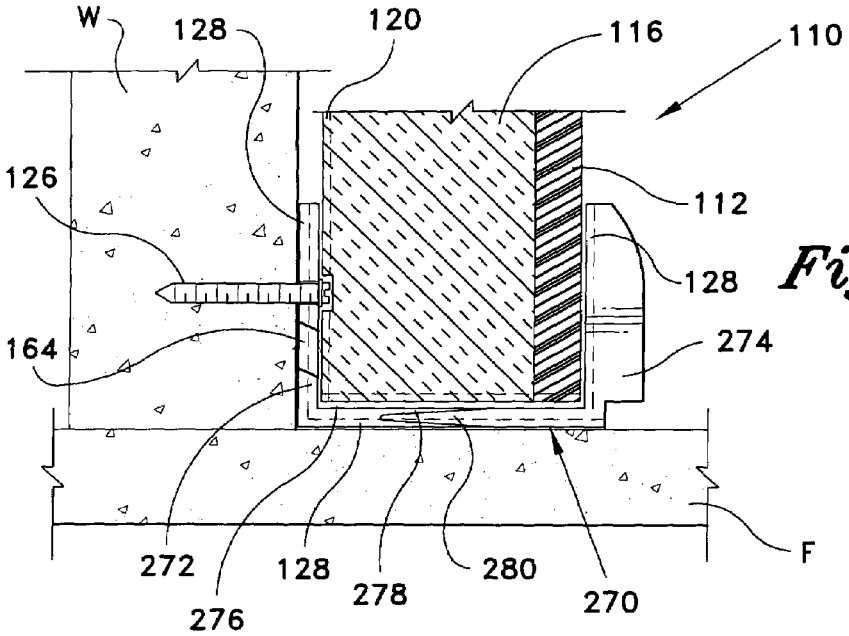
FIG. 15 is a side cross-section view of a wall panel and two-piece snap bracket of the wall finishing system according to the present invention.
Figure 16:
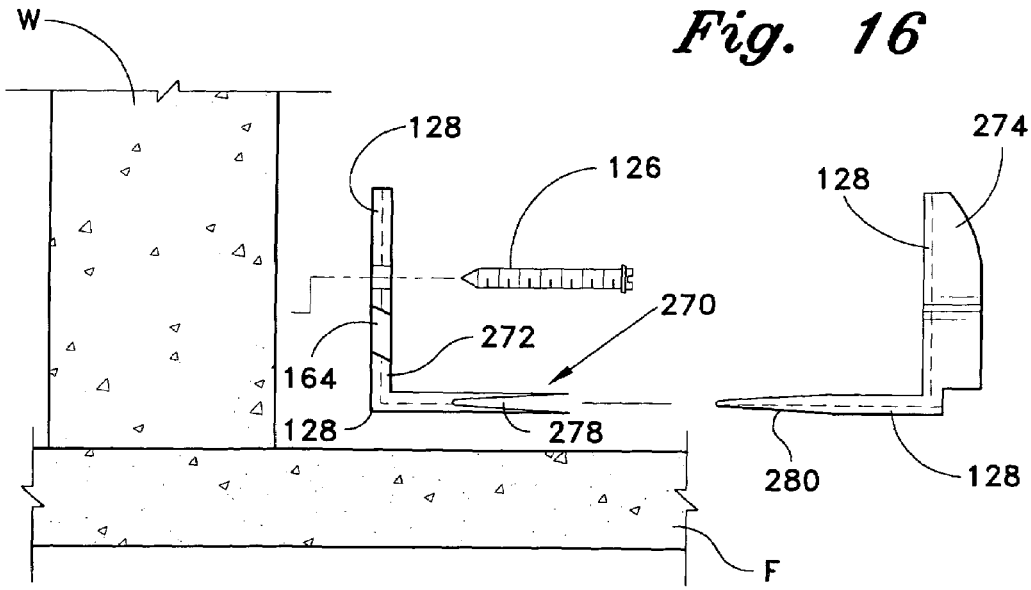
FIG. 16 is an exploded side cross-section view of a wall panel and two-piece snap bracket of the wall finishing system according to the present invention.

Referring now to FIGS. 15-16, a two-piece snap bracket 270 comprises a rear plate 272 and a trim section 274 that may be secured together to form a U-shaped channel 276 into which the wall panels 110 may be secured. The rear plate 272 has a bottom receiving cavity 278, and the trim section 274 has a bottom peg 280 that snaps into the receiving cavity 278.

Figure 12:
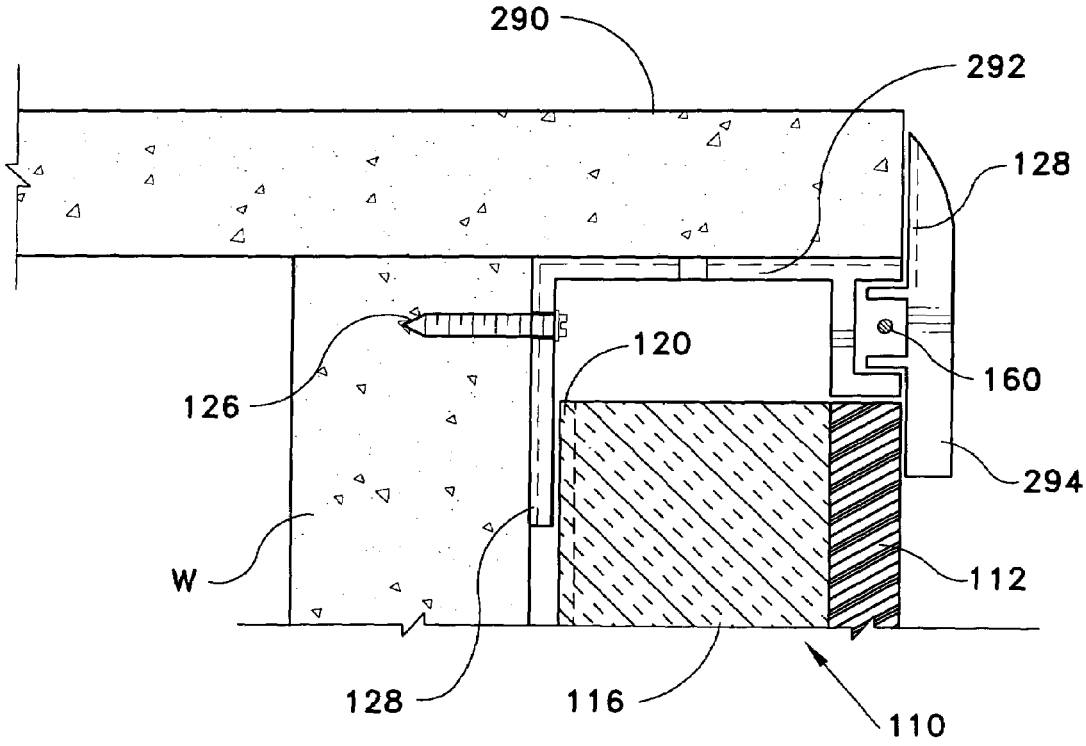
FIG. 12 is a side cross-section view of a window jamb and a window bracket of the wall finishing system according to the present invention.

The wall panels 110 may be cut to expose any windows that may exist in the masonry walls W. Referring to FIG. 12, when finishing around a window, an extended window jamb 290 is secured to the window, and a window bracket 292 is secured to the jamb 290. The trim 294 used in the window bracket 292 curves downward, away from the window jamb 290. Optionally, the two-piece snap bracket 270 may be used around the window jamb 290 instead of the window bracket 292. The trim section 274 of the two-piece snap bracket 270 may be extended to cover the window jamb 290 when used around the window.

Figure 13:
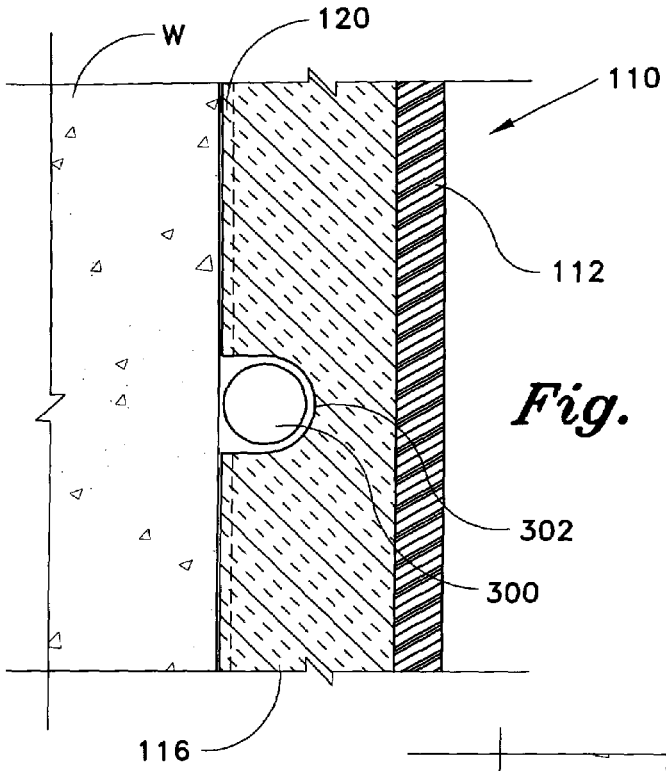
FIG. 13 is a cross-section view of a wall panel with side conduit of the wall finishing system according to the present invention.
Figure 14:
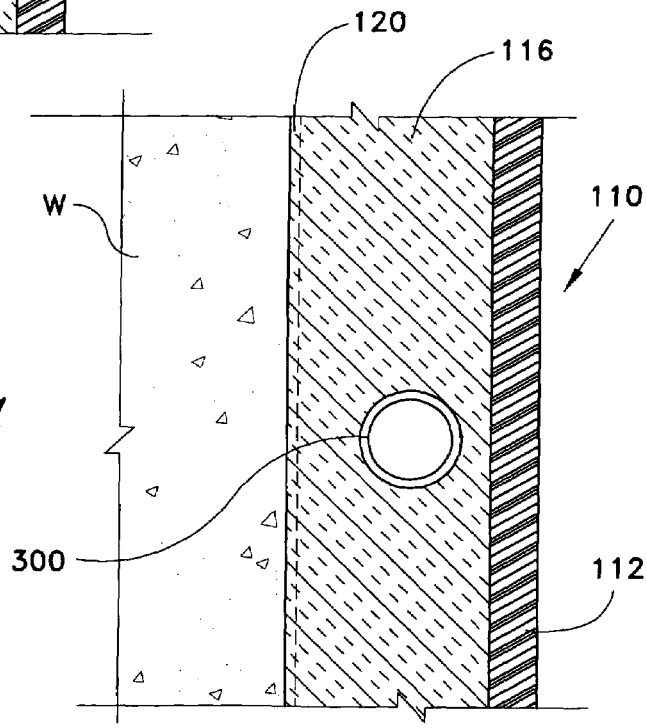
FIG. 14 is a cross-section view of a wall panel with central conduit of the wall finishing system according to the present invention.

The wall panels 110 may also be pre-fabricated with UL rated electrical conduit 300 passing either horizontally or vertically through the panels 110. The conduit 300 may pass entirely through the insulation layer 116 in the panels 110, as shown in FIG. 14, or the conduit 300 may be passed through a channel 302 on the rear surface 120 of the insulation layer 116 in the panels 110 as shown in FIG. 13. The conduit 300 allows electrical wiring to be easily run throughout the building, or may be enlarged for use with HVAC ductwork or plumbing.

It is to be understood that the present invention is not limited to the embodiments described above, but encompasses any and all embodiments within the scope of the following claims.

I claim:

1. A wall finishing system for use in a building structure, comprising:

a plurality of generally rectangular, connectable panels having a first rigid finishing material layer and an insulating layer, said first rigid finishing material layer having a front surface and a rear surface, said insulating layer having a front surface, an uneven rear surface and a pair of uneven side surfaces, said insulating layer secured to said first rigid finishing material layer, such that the front surface of said insulating layer is secured to the rear surface of said first rigid finishing material layer, whereby the uneven rear surface and side surfaces allow for the air and moisture to be ventilated from behind said panels;

a top mounting bracket adapted for securement along the ceiling of the building structure, said top mounting bracket having a rear plate, a top plate, a front plate, and a decorative trim, the rear plate and top plate having uneven surfaces such that the uneven surfaces allow for the air and moisture to be ventilated from behind said connecting panels, the rear plate, top plate, front plate and decorative trim defining a U-shaped channel, wherein the decorative trim is disposed generally parallel to the rear plate such that the U-shaped channel receives and holds the top end of said connectable panels; and a bottom mounting bracket adapted for securement along the floor of the building structure, said bottom mounting bracket having a substantially continuous rear plate, a bottom plate, a front plate, and a first decorative trim, the rear plate and bottom plate having uneven surfaces such that the uneven surfaces allow for the air and moisture to be ventilated from behind said connecting panels, the rear plate, bottom plate, front plate, and first decorative trim defining a U-shaped channel, wherein the decorative trim is disposed generally parallel to the rear plate such that the U-shaped channel receives and holds the bottom end of said connectable panels.

2. The wall finishing system according to claim 1, wherein said connectable panels further comprise electrical conduit passing through the insulation layer from one top or side surface to another top or side surface.

3. The wall finishing system according to claim 1, wherein said connectable panels further comprise a second rigid finishing material layer, the second rigid finishing material layer secured to the rear surface of said insulating layer.

4. The wall finishing system according to claim 1, wherein said bottom mounting bracket further comprises a low voltage wire chase passing horizontally through the U-shaped channel, such that said low voltage wire chase may be used to connect electric devices such as telephones, speakers, telecoms, or cable television systems.

5. The wall finishing system according to claim 1, wherein said bottom mounting bracket further comprises a top plate, wherein said top plate is connected to the rear plate and the decorative trim, and said top plate is offset from the bottom plate, such that said connectable panels may rest on said top plate.

6. The wall finishing system according to claim 5, wherein said top plate further comprises a hole defined in the top plate, such that the hole allows access to the means for securing the bottom plate to the floor.

7. The wall finishing system according to claim 5, wherein said bottom mounting bracket further comprises at least one electrical conduit passing horizontally through said bottom mounting bracket, wherein said electrical conduit is disposed between said top plate and the bottom plate.

8. The wall finishing system according to claim 5, wherein said bottom mounting bracket further comprises a portion of insulation disposed between said top plate and the bottom plate.

9. The wall finishing system according to claim 5, wherein said bottom mounting bracket further comprises a plurality of vents defined in the rear plate, such that the vents allow air to circulate from behind the wall panels into the interior of the room.

10. The wall finishing system according to claim 5, wherein said bottom mounting bracket further comprises a water deflection lip protruding from the rear plate into the U-shaped channel, such that moisture may drain from behind the wall panels into the U-shaped channel for collection and evacuation.

11. The wall finishing system according to claim 1, wherein said bottom mounting bracket further comprises a second decorative trim, whereby said second decorative trim is secured to the rear plate, such that said bottom mounting bracket may be used away from a masonry wail to support an interior wall panel.

12. The wall finishing system according to claim 11, wherein said bottom mounting bracket further comprises a top plate, wherein said top plate is connected to said first decorative trim and said second decorative trim, such that said wall panel may be supported on said top plate.

* * * * *